United States Patent [19]

Lövqvist

[11] 3,938,300

[45] Feb. 17, 1976

[54] ARRANGEMENT IN REFUSE CHUTES

[76] Inventor: Karl Bo Lennart Lövqvist, Nyvallsvagen 13, 802 39 Gavle, Sweden

[22] Filed: Mar. 20, 1975

[21] Appl. No.: 560,655

Related U.S. Application Data

[63] Continuation of Ser. No. 339,686, March 9, 1973.

[30] Foreign Application Priority Data

Mar. 9, 1972 Sweden ..... 3019/72

[52] U.S. Cl. ..... 53/124 E; 53/197

[51] Int. Cl.[2] ..... B65B 1/20

[58] Field of Search ..... 53/124 E, 124 B, 197

[56] References Cited

UNITED STATES PATENTS

| | | | |
|---|---|---|---|
| 3,380,220 | 4/1968 | Jennings et al. | 53/124 E X |
| 3,412,523 | 11/1968 | Raymond et al. | 53/197 |
| 3,553,924 | 1/1971 | Bonami | 53/197 X |

*Primary Examiner*—Travis S. McGehee
*Attorney, Agent, or Firm*—Fred Philpitt

[57] ABSTRACT

The present invention relates to an arrangement in refuse chutes for collecting refuse received from said chute.

10 Claims, 5 Drawing Figures

ARRANGEMENT IN REFUSE CHUTES

This is a continuation of application Ser. No. 339,686, filed Mar. 9, 1973, now abandoned.

For the collection of refuse from refuse chutes one has hitherto used collecting receptacles in the form of barrels or bins which have been placed beneath the refuse chute and are emptied when filled or at regular intervals. One disadvantage with such receptacles is that they are difficult to handle owing to their large dimensions, this being true in the case said receptacles are not integrated in an automatic refuse receiving system comprising several smaller receptacles. Furthermore the inner suface of said receptacles will soon collect dirt from the refuse received from said chute, said refuse being often insufficiently packaged or tied. Finally the substantial disadvantage of the receptacle being overfilled can be mentioned. In this case portions of the refuse will often spill over and reach the floor of the room to which the refuse chute leads.

It is also known to use bags or sacks for instance of paper or plastics supported by special stands or holders, said bags being replaced by new ones at each operation for removing and transport of refuse. The object of the present invention is to provide an arrangement by means of which the removal of refuse from the refuse chute can be carried out in an advantageous manner from the point of view of costs and without risk for the service personal coming into contact with the refuse.

An arrangement according to the invention has the characterizing features stated in the enclosed claims.

The invention will be described in more detail hereinbelow with reference to the accompanying drawings, which illustrate some embodiments.

Figure 1:
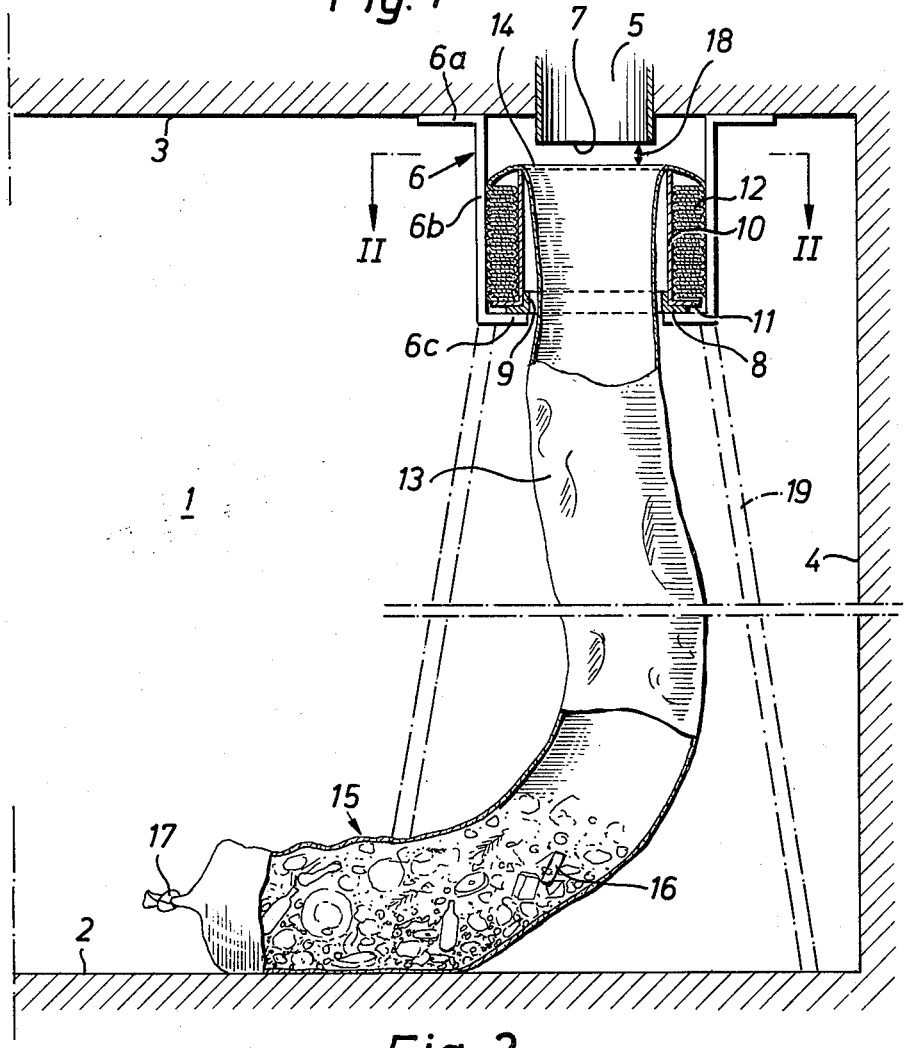
FIG. 1 shows one embodiment of an arrangement according to the invention, said arrangement being secured to the ceiling of the space in which the refuse chute mounts.

In FIG. 1 the designation 1 refers to the space or room, having a floor 2, a ceiling 3 and walls 4, to which a refuse chute pipe 5 leads. The pipe extends beneath the ceiling 3 only to a limited degree. The designation 6 refers to a holder for a magazine 12 of hose-like film, said holder comprising two horizontal portions 6*a* secured to the ceiling 3, two vertical portions 6*b* and two horizontal portions 6c secured to the lower ends of the portions 6*b*. A ring-like member 8 is secured to the portions 6*c*. Said member 8 is L-formed as seen in cross-section and comprises an upwardly directed, cylindrical portion 9 having a limited height. A cylindrical sleeve or ring 10 is applied around the cylindrical portion 9 and serves as support or core for the film magazine 12. At its lower end the sleeve 10 can be provided with a horizontal flange 11 by means of which the film material is prevented from falling down from its place around said sleeve 10.

In the shown arrangement hose-like film 13 is taken from the film magazine 12 and is drawn over the upper edge 14 of the cylinder 10 and thereafter through a cylinder 10 and the ring-formed member 8 downwards to the floor 2 of the room where it forms a bag or sack 15 for the refuse 16 received from the refuse chute. The bottom of the bag is closed at 17 for instance by means of a knot.

The manner in which the shown arrangement funtions appears directly from the figures. Refuse from the pipe 5 falls down through the arrangement and is collected in the hose 13. When the collected refuse shall be removed from the space the hose is cut-off just above the level of the refuse in the hose whereafter the part of the hose hanging down from the arrangement is closed, for instance by means of a knot, thereby forming a new bag. The bag containing the refuse can thereafter be removed in a simple manner.

Since the device according to FIG. 1 is positioned near the ceiling 3 of the space 1, i.e. at a considerable distance from the floor 2 the bag of the packaging material which becomes successively filled will soon become unstable and will tip laterally after having been filled sufficiently.. Thereby a further quantity of hose will be drawn out from the magazine 12 and be successively filled with new refuse until the new sack-section thus formed will become unstable in its turn and tip laterally etc. By this function the supervision of the collecting arrangement will be simplified in comparison with the known arrangement comprising refuse receptacles which are limited to receive only a predetermined quantity of refuse. However, nothing prevents the house serviceman from checking the device at intervals for instance for compressing the refuse in order to minimize the comsumption of hoselike packaging material.

According to the invention it has also shown to be suitable especially in refuse chutes which by means of a suction fan are maintained at a subatmospheric pressure to position the device according to the invention in such manner that there is between the lower edge 7 of the refuse chute and the upper edge 14 of the magazine core 10, a preferably uniform and ring-formed interspace or slot 18 allowing air to enter the pipe and the hose. One of the objects with this slot is to prevent a thin hose from being sucked upwards into the pipe 5 if there is a subatmospheric pressure in the latter. Another object is to allow the hose 13 to be filled with air (blown up) by the action of a falling package of refuse in the chute before the package enters the hose. This effect is obtained owing to air current phenomena in the chute, the hose and the slot obtained when a package is falling down through the chute. One advantage with the slot 18 in chutes maintained at subatmospheric pressure is, of course, also the fact that ventilation air is allowed to pass upwards through the chute.

One of the most important advantages, not mentioned before, with the device according to the invention is that the service personnel need not come into contact with the refuse or with refuse receptacles contaminated with refuse products. The hose 13 which is quite tight (impervious) throughout its entire surface also prevents nasty-smelling gases from escaping from the bag filled with refuse.

Figure 2:
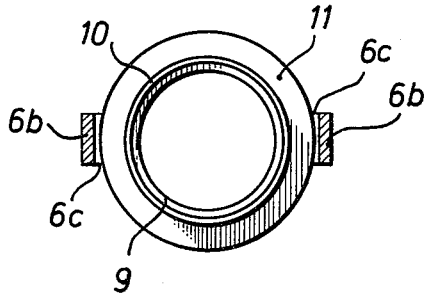
FIG. 2 shows a section through an arrangement according to FIG. 1 taken along the section II—II in FIG. 2.

In the device shown in FIGS. 1–2 the vertical portions 6*b* of the holder 6 — said portion being shown in FIG. 1 in the form of a rigid bar — can partly or wholly be replaced by a member which is elastical in vertical direction, for instance a helical spring. By such modification the hose magazine 12 and the hose 13 can be resiliently moved downwards if a falling refuse package should hit said magazine or hose. Although the hose material proper can withstand the frictional forces excerted by the falling refuse package the traction force generated in the case the holder is not resiliently supported can sometimes by so great that too much quantity of hose is drawn from the magazine 12. This unnecessary consumption of foil can be decreased or prevented by means of the resilient or elastic suspension of the hose magazine mentioned above.

Figure 3:
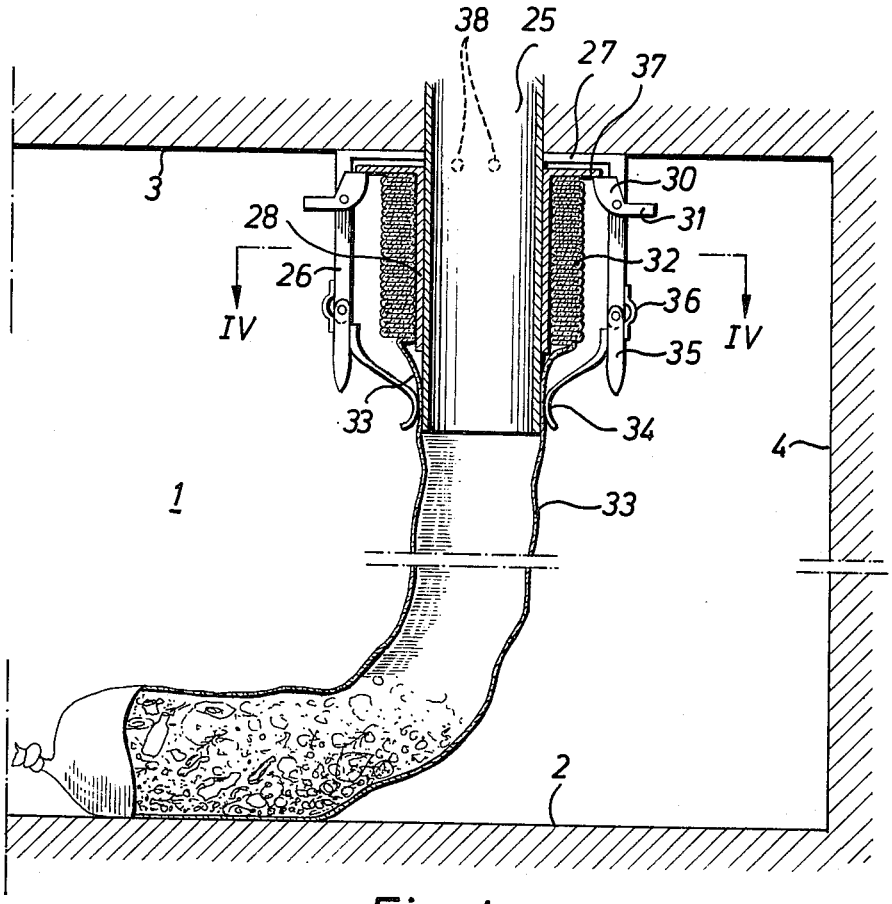
FIG. 3 shows another embodiment attached to the refuse chute pipe proper and also comprises auxiliary means for controlling the feed of hose-like packaging material.
Figure 4:
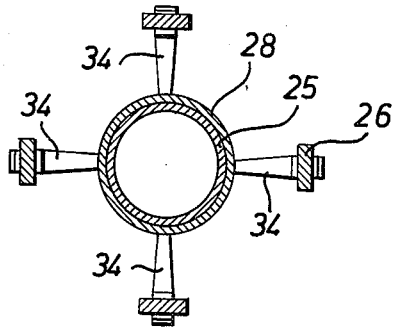
FIG. 4 shows a section through the arrangement according to FIG. 3 taken along the section IV—IV in FIG. 3.

In the embodiment shown in FIGS. 3 to 4 the refuse chute pipe 25 extends with a relatively long portion beneath the ceiling 3 of the room 1. The holder 26 for the hose magazine 32 is applied to the pipe 25 and/or the ceiling 3 in any manner known per se by means of portions 27 of the holder. The hose magazine 32 is applied around the pipe 25 and is supported by a core or sleeve 28 which is cylindrical and at its upper end connected to a circular flange 37, the outer radius of which being greater than the radius of the hose magazine 32. In the holder 26 a locking means 30 with a handle 31 is pivotably mounted, said locking means providing support for the flange 37 in the mounting portion of the foil magazine. By operating the handle 31 the locking effect can be released so that the core 28 can be removed from the pipe 25. At the insertion of a new, unused hose magazine the core 28 with the magazine can be pressed upwards over the pipe 25. The locking means 30 will then be forced outwards until the flange 37 has passed said means whereafter the latter is snapped back under the flange for instance by a spring (not shown) whereafter the flange is locked in the desired position.

The shown embodiment is also provided at the lower end of the holder 26 with a device for increasing the force required for drawing hose 33 from the magazine 32. The device comprises a means 34, for instance a spring, adapted to press the hose against the outer surface of the pipe 25 with a suitable force. The means 34 together with a handle 35 for the operation of said means 34 is swingably connected to the lower end of the holder 26 and is provided with a spring 36 generating or contributing to generate the resilient pressure between the member 34 and the hose 33. When the hose magazine shall be exchanged the member 34 is swung outwardly to a position in which it can suitably be held by means of a locking means (not shown). One difference between the embodiment according to FIGS. 1 to 2 is that the hose in the first-mentioned embodiment is drawn upwards over the upper edge of the core 10 and thereafter downwards through the device, while the hose in the embodiment according to FIGS. 3 to 4 is taken from the foil magazine 32 at the lower end thereof and is drawn directly downwards for the purpose of form collecting bag for the refuse. Another difference is that in the embodiment according to FIGS. 1 to 2 no measures have been taken for increasing the force with which hose is drawn from the magazine other than the measure of allowing the hose to run over the upper edge of the core 10, while in the embodiment according to FIGS. 3 to 4 special means are provided for this purpose. However, the friction between the hose material and the upper edge of the core 10 in the first-mentioned embodiment is often sufficient to prevent excessive drawing out of hose by a falling package of refuse. In some cases it might nevertheless be advantageous to provide extra means for braking the speed with which hose material is drawn from the magazine, also in the embodiment according to FIGS. 1 to 2.

In the shown embodiments the hose magazine is first inserted in its place in the collecting device whereafter the end portion of the hose is drawn out and closed, for instance by means of a knot or special closing means. As refuse falls from the refuse chute and enters the foil bag thus formed the latter is lowered successively until it reaches the floor of the room 1 whereafter the bag is further filled with refuse. When the sack is filled up to near the hose magazine it is possible to move the bag while drawing off further hose from the magazine. The bag is intended to be removed from the room 1 at regular intervals for instance once or twice a day after cutting off the hose and closing the end thereof hanging down from the hose magazine.

If the free distance between the lower end of the collecting device and the floor of the room is sufficiently large, for instance at least 1,5 mm, there is a great probability that the filled bag will be tilted or tipped by its own weight and fall down to the floor while drawing out new hose material. In such case the service operations need not be as frequent as usual.

In an ordinary refuse chute the pipe of the refuse chute can have a diameter of about 400 to 700 mm. The hose-like packaging material can have a so much larger diameter that the hose magazine can easily be applied around the cylindrical space corresponding to the pipe of the refuse chute, for instance a diameter of about 450 to 800 mm. The thickness of the hose-like packaging material can be about 0.02 to 0.1 mm, for instance 0.04 to 0.08 mm. The height of the hose magazine should be as small as possible, probably not greater than the diameter of the hose, thereby leaving as much free space as possible for the refuse bag beneath the magazine. In ordinary refuse chutes the slot 18 shown in FIG. 1 can have a width of about 10 to 200 mm, preferably 25 to 85 mm. In the magazine the hose is folded with the folds extending circumferentially of the hose as appears from the Figs. The manner in which the magazine is produced by folding the hose-like material need not be described in detail. The hose can be applied on a prismatic core or sleeve made of corrugated board, plastic, sheet metal or the like, and the sleeve can be provided with axial bends or slots allowing the magazine to be compressed into a flat configuration for facilitating the transport and storage thereof before use.

Instead of being supported by a holder attached to the refuse chute pipe or to an adjacent portion of the building as in the shown embodiments the magazine can be, if desired, supported by a stand 19 from the floor 2, as schematically shown in FIG. 1 by means of broken lines or it may be supported from an adjacent vertical wall of the room 1 by means of a suitable bracket.

In the embodiments shown in FIGS. 3 to 4 it is possible above the hose magazine to provide a number of perforations 38 in the walls of the refuse chute pipe 25 as shown in FIG. 3 by broken lines, said perforations having a similar ventilation effect as the slot 18 shown in FIG. 1.

If desired, it is possible beneath the refuse chute pipe to provide a protecting shield (not shown) wholly or partly enclosing the bag formed by the hose-like material. Said shield or casing can be arranged so as to be shiftable from a normal position in which the casing protects the hose against penetration of pointed or sharp refuse particles to an emptying position in which the bag can easily be removed from the space within said casing.

The hose-like packaging material can consist of a plastic film, e.g. of polyethylene, polypropylene, polyvinyl chloride, or any other flexible, low-cost material.

Figure 5:
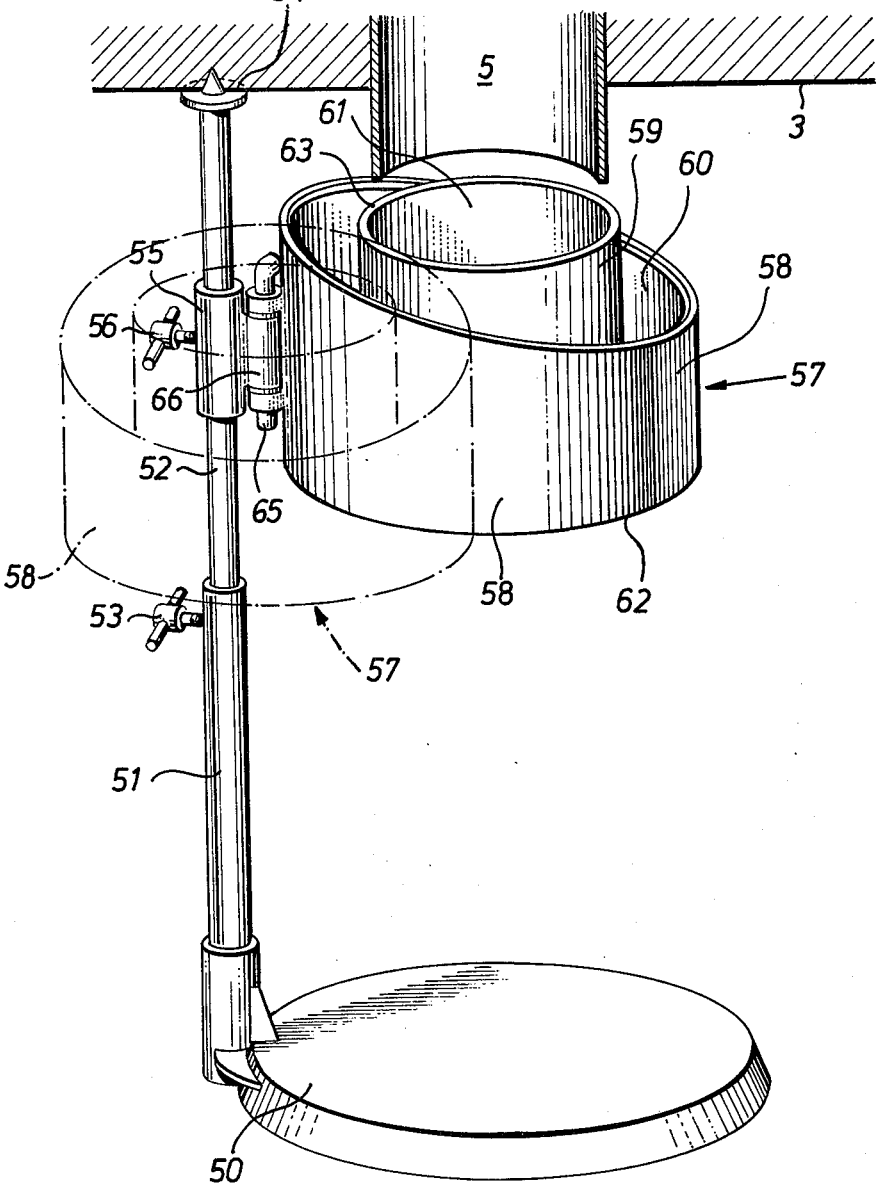
FIG. 5 is a perspective view of a third embodiment of my invention.

FIG. 5 illustrates an embodiment of the invention in which a holder 57 for a magazine of hose-like packaging material (not shown) is swingably mounted to a support 51, 52 so as to be movable between a first position vertically below the lower end of a refuse chute and a second position out of the path of the refuse falling down from said refuse chute. The embodiment comprises a platform 50, a support 51, 52 and a holder 57 for a magazine of hose-like packaging material. The support comprises a lower tubular portion 51 secured to the ouuter edge of the platform 50 and an upper portion 52 which is slidably inserted into the portion 51 and can be locked in a desired position by means of a locking screw 53. A sleeve 55 is slidably mounted around the support portion 52 and can be locked in a desired position by means of a locking screw 56. The upper end of the support portion 52 is provided with a tip 54 which can be driven into the ceiling of the room in which the refuse chute terminates at a place near said chute for fixing the position of said support.

The sleeve 55 carries a hinge comprising a sleeve 66 and a tap 65 extending through the sleeve 66. The upper end of the tap 65 is secured to an outer, cylindrical portion 58 of a holder 57 for a magazine of hose-like packaging material, preferably of polyethylene or other plastic material. The holder further comprises an inner, cylindrical tubelike portion 59 the lower end of which being connected to the lower end of the outer portion 58 by means of a horizontal, flat bottom ring member 62 extending only between the portions 58 and 59. The ring-formed space 60 between the portions 58 and 59 is intended for accomodating a magazine of hose-like packaging material of the type shown in FIG. 1. The packaging material is drawn from the magazine and is fed up over the edge 63 of the holder portion 59 and thereafter down through the free space 61 in the portion 59 so as to form under the holder 57 a sac-like refuse receptacle which will be supported by the platform 50.

In the position shown by full lines in FIG. 5 and after inserting a magazine of packaging material in the space 60 the device is ready for collecting refuse coming from the refuse chute.

When it is time for replacing an emptied magazine by a new one the holder 57 is rotated about the hinge 65, 66 so as to be shifted to the position indicated by broken lines in FIG. 5 in which position the holder 57 is outside of the path of any refuse falling down through the refuse chute.

By means of the setting screw 56 the holder 57 can be adjusted vertically to a position at a suitable distance from the lower end of the refuse chute.

The invention is not limited to the shown embodiments since the latter can be varied and modified in various manner within the scope of the invention.

I claim:

1. An arrangement for collecting refuse, comprising in combination:

a. a refuse collection room having walls including a floor and a ceiling, b. a vertically disposed refuse discharge chute extending vertically upwardly through the ceiling of said refuse collection room, the lower end of said chute opening into said room at a point near the ceiling of said room, c. a magazine of hose-like impervious material which is to form a single elongated tubular receptacle for refuse, said impervious material being disposed in a folded condition, wherein the folds extend substantially in a circumferential direction, d. magazine holder means for confining said magazine of impervious material in an essentially ring-formed column that has a vertical axis that substantially coincides with the vertical axis of the outlet of said vertically disposed discharge chute, e. said magazine holder means and said magazine forming a substantially vertical passageway for receiving refuse discharged from said discharge chute and f. support means in said refuse collection room for supporting said magazine holder near the lower end of the refuse chute so as to leave between the lower end of said chute and the upper end of said magazine a passage allowing air to enter the refuse chute pipe while allowing the hose-like impervious material to be inflated by the action of refuse discharged from said refuse discharge chute, g. said magazine holder means being supported by said support means so that in a first position there will be a general axial alignment of the inlet of said ring-formed column with said discharge chute, and so that in a second position the said ring-formed column means will be wholly removed from alignment with said discharge chute.

2. An arrangement as set forth in claim 1 which includes means for resiliently controlling the dispensing of the tubular receptacle from said magazine holder.

3. An arrangement as set forth in claim 1 in which said support means is secured adjacent the loweer end of said refuse chute pipe.

4. An arrangement as set forth in claim 1 in which said support means is secured to said ceiling of said refuse collection room, the upper part of said support means being adjacent to said refuse discharge chute.

5. An arrangement as set forth in claim 1 in which said magazine holder is adjustably secured with respect to said support means so as to enable said magazine holder to be positioned at a desired position near the lower end of the refuse discharge chute.

6. An arrangement as set forth in claim 1 including means for increasing the resistance to drawing the tubular receptacle from said magazine.

7. An arrangement as set forth in claim 4 which said magazine holder in a first position is positioned near the lower end of said refuse discharge chute so as to leave between the lower end of said chute and the upper end of said magazine holder a narrow, ring-formed slot which will allow air to enter the refuse discharge chute pipe while allowing the tubular receptacle to be inflated by the action of a refuse package falling through the refuse discharge chute.

8. An arrangement as set forth in claim 1 in which said magazine holder is pivotably mounted on said support means about an axis extending outside the circumference of said refuse discharge chute.

9. An arrangement as claimed in claim 1 in which said magazine holder comprises a substantially ring-formed core for said magazine, said core being supported in a vertical position at its lower end in a first position so as to enable said hose-like material to be drawn from said magazine over the upper end of said core and thereafter down through said core to form a tubular receptacle for said refuse.

10. An arrangement as set forth in claim 1 in which said hose-like material consists of an impervious foil of plastic material chosen from the group consisting of polyethylene and polypropylene.

* * * * *